US006279330B1

(12) United States Patent
Ueno et al.

(10) Patent No.: US 6,279,330 B1
(45) Date of Patent: Aug. 28, 2001

(54) APPARATUS AND METHOD FOR CLEANING PIPES OF REFRIGERATING UNIT

(75) Inventors: Takeo Ueno; Toshihiro Iijima; Masaaki Takegami, all of Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/508,375

(22) PCT Filed: Sep. 8, 1998

(86) PCT No.: PCT/JP98/04020

§ 371 Date: Mar. 10, 2000

§ 102(e) Date: Mar. 10, 2000

(87) PCT Pub. No.: WO99/13279

PCT Pub. Date: Mar. 18, 1999

(30) Foreign Application Priority Data

Sep. 11, 1997 (JP) ..... 9-246672

(51) Int. Cl.[7] ..... F28G 13/00
(52) U.S. Cl. ..... 62/77; 62/303
(58) Field of Search ..... 62/303, 77, 188, 62/174

(56) References Cited

U.S. PATENT DOCUMENTS 4,539,817 * 9/1985 Staggs et al. ..... 62/149
4,982,578 * 1/1991 Proctor et al. ..... 62/292
5,167,126 * 12/1992 Cartwright .
5,363,662 * 11/1994 Todack ..... 62/85
5,379,605 * 1/1995 Outlaw et al. ..... 62/303
5,415,003 * 5/1995 Bertva et al. ..... 62/303
5,497,625 * 3/1996 Manz et al. ..... 62/3.3
5,533,359 * 7/1996 Muston et al. ..... 62/292
5,582,019 12/1996 Hanna et al. ..... 62/85

FOREIGN PATENT DOCUMENTS

1016837A1 * 7/2000 (EP) .
60029591 * 2/1985 (JP) .
61070388 * 4/1986 (JP) .
61070387 * 11/1986 (JP) .
62026491 * 2/1987 (JP) .
4-254173 9/1992 (JP) .
5-280839 10/1993 (JP) .
6-221727 8/1994 (JP) .
7-127953 5/1995 (JP) .
7-243723 9/1995 (JP) .
8-303909 11/1996 (JP) .
WO9715799 * 1/1997 (WO) .
97 15789 5/1997 (WO) .

* cited by examiner

*Primary Examiner*—William E. Tapolcai

(57) ABSTRACT

A piping cleaning system switches over a four-way switching valve 43 of a heat pump circuit 200 so that two transfer heat exchangers 25, 26 are operated alternately as a cooling device and a heating device, by which a cleaning refrigerant in a cleaning circuit 2 is circulated through a gas line 3 and a liquid line 5. During this cleaning operation with the cleaning refrigerant circulated, when the cleaning refrigerant runs short in amount, a solenoid valve SV3 is opened so that cleaning refrigerant of the refrigerant cylinder 71 is resupplied through a refrigerant resupply line 72 to either one of the transfer heat exchangers 25 or 26 that is cooling. On the other hand, when the cleaning refrigerant is excessive, a solenoid valve SV4 is opened so that the cleaning refrigerant is returned to the refrigerant cylinder 71 through a refrigerant bleed line 73. Thus, the amount of cleaning refrigerant can be maintained at an appropriate level.

17 Claims, 1 Drawing Sheet

APPARATUS AND METHOD FOR CLEANING PIPES OF REFRIGERATING UNIT

This application is the national phase under 35 U.S.C. §371 of PCT International Application No. PCT/JP98/04020 which has an International filing date of Sep. 8, 1998, which designated the United States of America.

TECHNICAL FIELD

The present invention relates to a piping cleaning system and a piping cleaning method for refrigeration units including air conditioners and refrigerators.

BACKGROUND ART

In renewal demands of various types of air conditioners, existing refrigerant piping is often re-used as it is. In such a case, if a refrigerant for the existing refrigerant circuit and a refrigerant for a new refrigerant circuit are the same CFC (chlorofluorocarbon) or HCFC (hydrochlorofluorocarbon) refrigerant, the existing refrigerant piping can be used without causing any significant problems.

However, from the recent years' environmental point of view or the like, it has been proposed to use HFC (hydrofluorocarbon) refrigerants instead of conventional CFC or HCFC refrigerants.

In this case, for reuse of the existing refrigerant piping, it is necessary to clean the interior of the refrigerant piping. That is, it is often the case that lubricating oil have been deposited on or contaminants or the like have stuck to the interior surfaces of the existing refrigerant piping. In particular, whereas mineral oil has been used lubricating oil for conventional CFC refrigerants and the like, synthetic oil is used as lubricating oil for HFC refrigerants. This causes a problem that mineral oil, if remaining in the existing refrigerant piping, would cause contaminations to occur to a newly provided refrigerant circuit, with the result that the throttle mechanism may be blocked or that the compressor may be damaged.

DISCLOSURE OF THE INVENTION

Therefore, an object of the present invention is to provide a piping cleaning system and a piping cleaning method for refrigeration units capable of cleaning the refrigerant piping with good efficiency.

In order to achieve the above object, the present invention provides a piping cleaning system for refrigeration units, comprising:

a cleaning circuit for cleaning refrigerant piping by circulating a refrigerant therethrough;

refrigerant amount detecting means for detecting an amount of refrigerant with which the refrigerant piping is cleaned; and adjusting means for adjusting cleaning refrigerant amount based on the amount of refrigerant detected by the refrigerant amount detecting means.

In this invention, the refrigerant piping is cleaned by circulating the refrigerant through the cleaning circuit. In this process, the amount of refrigerant with which the refrigerant piping is cleaned is detected by the refrigerant amount detecting means and, based on the detected amount of refrigerant, the cleaning refrigerant amount is adjusted by the adjusting means. Therefore, according to this invention, any excess or shortage of the refrigerant with which the refrigerant piping is cleaned can be eliminated, and so the refrigerant piping can be cleaned efficiently. A short amount of the cleaning refrigerant would cause the cleaning performance to lower, while an excessive amount of the cleaning refrigerant would lead to a less smooth circulation of the refrigerant.

Also, a piping cleaning system for refrigeration units according to one embodiment further comprises a transfer heat exchanger provided halfway on the cleaning circuit; and a heat pump to cause the transfer heat exchanger to alternately iterate a sucking operation by cooling a gas refrigerant within the transfer heat exchanger to effectuate depressurization thereof so that a refrigerant is sucked in from outside thereto, and a discharge operation by heating the refrigerant within the transfer heat exchanger to effectuate pressurization thereof so that a liquid refrigerant is discharged therefrom, for circulating a liquid refrigerant through the refrigerant piping by the transfer heat exchanger.

In this piping cleaning system, the transfer heat exchanger performs a heat pump action of alternately iterating the sucking operation by cooling a gas refrigerant within the transfer heat exchanger to effectuate depressurization thereof so that a refrigerant is sucked in from outside thereto, and the discharge operation by heating the refrigerant within the transfer heat exchanger to effectuate pressurization thereof so that a liquid refrigerant is discharged therefrom.

According to such a heat pump action, there is no need of circulating the refrigerant in the cleaning circuit by a compressor, and therefore the fear that foreign matters from the compressor may mix into the refrigerant piping can be eliminated.

Also, a piping cleaning system of another embodiment comprises two transfer heat exchangers provided halfway on the cleaning circuit and connected in parallel to each other; and a heat pump to cause the transfer exchangers to alternately iterate a sucking operation by cooling a gas refrigerant within the transfer heat exchangers to effectuate depressurization thereof so that a refrigerant is sucked in from outside thereto, and a discharge operation by heating the refrigerant within the transfer heat exchangers to effectuate pressurization thereof so that a liquid refrigerant is discharged therefrom, for circulating a liquid refrigerant through the refrigerant piping by the transfer heat exchangers.

In this piping cleaning system, the two transfer heat exchangers perform a heat pump action of alternately iterating the sucking operation by cooling a gas refrigerant within the transfer heat exchangers to effectuate depressurization thereof so that a refrigerant is sucked in from outside thereto, and the discharge operation by heating the refrigerant within the transfer heat exchangers to effectuate pressurization thereof so that a liquid refrigerant is discharged therefrom.

According to such a heat pump action, there is no need of circulating the refrigerant in the cleaning circuit by a compressor, and therefore the fear that foreign matters from the compressor may mix into the refrigerant piping can be eliminated.

Also, in one embodiment, the adjusting means of the cleaning refrigerant amount is implemented by at least one of a refrigerant resupply line connected to the transfer heat exchanger and serving for resupplying the refrigerant to the cleaning circuit and a refrigerant bleed line connected to the transfer heat exchanger and serving for taking out the refrigerant from the cleaning circuit.

In this piping cleaning system, when the cleaning refrigerant in the cleaning circuit runs short, the cleaning refrigerant can be supplied to the transfer heat exchanger through the refrigerant resupply line and the cleaning refrigerant can be heated by this transfer heat exchanger, so that the cleaning refrigerant can be resupplied to the cleaning circuit efficiently. Also, when the cleaning refrigerant in the cleaning circuit is excessive, excess refrigerant accumulated in the transfer heat exchanger can be bled efficiently by the refrigerant bleed line. Thus, the amount of cleaning refrigerant can be maintained normally at an appropriate level, and the refrigerant piping can be cleaned efficiently.

Also, in another embodiment, separating means for separating foreign matters from the refrigerant is connected to the cleaning circuit, and the refrigerant amount detecting means is implemented by a refrigerant level sensor provided on the separating means.

In this piping cleaning system, the cleaning performance by the cleaning refrigerant can be maintained by separating foreign matters from the cleaning refrigerant by means of the separating means, and besides the amount of cleaning refrigerant can be detected by the refrigerant level sensors provided on the separating means.

Also, in one embodiment, the heat pump has a throttle mechanism connected between the two transfer heat exchangers, a compressor and a four-way switching valve, and also has a heat pump circuit other than the cleaning circuit through which the cleaning refrigerant flows, wherein a flowing direction of working refrigerant flowing through the heat pump circuit is switched over by switching over the four-way switching valve, by which the sucking operation and the discharge operation of the two transfer heat exchangers are switched over;

the piping cleaning system further comprises four-way switching valve switching means for switching over the four-way switching valve when discharge pressure of the compressor becomes not less than a specified value, or when discharge gas temperature of the compressor becomes not more than a specified value, or when suction gas pressure of the compressor becomes not more than a specified value; and wherein the refrigerant amount detecting means detects a switching timing of the four-way switching valve switching means, and based on this switching timing, detects the amount of cleaning refrigerant.

In the case of this piping cleaning system, in the heat pump circuit, working refrigerant is circulated by the compressor through the four-way switching valve, one of the transfer heat exchangers, the throttle mechanism, the other transfer heat exchanger and the four-way switching valve in this order. Then, the liquid-phase cleaning refrigerant flows out from the one transfer heat exchanger under pressurization, causing the amount of heat exchange between working refrigerant and cleaning refrigerant in the heat pump circuit to lower, where when the discharge pressure of the compressor becomes not less than a specified value, the four-way switching valve switching means switches over the four-way switching valve. As a result, the one transfer heat exchanger is switched over from pressurizing operation to cooling operation while the other transfer heat exchanger is switched over from cooling operation to pressurizing operation. Also, the liquid-phase cleaning refrigerant is accumulated to a specified amount in the other transfer heat exchanger under cooling and a cooled refrigerant is sucked into the compressor, where when the discharge gas temperature of the compressor becomes not more than a specified value, the four-way switching valve switching means switches over the four-way switching valve. Still also, when suction gas pressure of the compressor becomes not more than a specified value, the four-way switching valve switching means switches over the four-way switching valve. Thus, a heat pump action of accumulating again the cleaning refrigerant in the transfer heat exchanger that has completely sent out the cleaning refrigerant, and simultaneously therewith sending out the cleaning refrigerant to the cleaning circuit from the transfer heat exchanger in which the cleaning refrigerant has been accumulated, is iterated.

In this case, the smaller the amount of cleaning refrigerant that is present in the cleaning circuit, the shorter the period at which the four-way switching valve is switched over by the four-way valve switching means, that is, the more frequently the four-way switching valve is switched over. Accordingly, the refrigerant amount detecting means is enabled to detect the largeness or smallness of the cleaning refrigerant amount by detecting the longness or shortness of the switching period of the four-way switching valve.

The reason why the smaller the amount of cleaning refrigerant, the shorter the switching period, is that the amount of heat exchange with working refrigerant becomes smaller, the discharge pressure increasing rate of the compressor becomes higher, and its discharge temperature decreasing rate becomes higher.

Also, a piping cleaning system of one embodiment comprises the refrigerant resupply line connected to a refrigerant cylinder;

a pressurizing line for introducing to the refrigerant cylinder a refrigerant gas pressurized by the transfer heat exchanger in order to pressurize the refrigerant cylinder; and a pressurizing valve provided on the pressurizing line.

In this piping cleaning system, upon a shortage of cleaning refrigerant, cleaning refrigerant can be resupplied from the refrigerant cylinder to the refrigerant resupply line.

In the case of an insufficient pressure of the refrigerant cylinder, where refrigerant supply from the refrigerant cylinder is stagnated, the pressurizing valve is opened so that the refrigerant gas is introduced into the refrigerant cylinder from the transfer heat exchanger via the pressurizing line, by which the pressure of the refrigerant cylinder can be maintained at a specified level. As a result, when the cleaning refrigerant runs short, the cleaning refrigerant can be speedily supplied from the refrigerant cylinder to the cleaning circuit without stagnation.

Also, a piping cleaning system of another embodiment comprises the refrigerant bleed line connected to a refrigerant cylinder;

a depressurizing line for introducing a refrigerant gas from the refrigerant cylinder to the transfer heat exchanger in order to depressurize the inter of the refrigerant cylinder by cooling the refrigerant gas within the refrigerant cylinder with the transfer heat exchanger; and a pressure-reducing valve provided on the depressurizing line.

In this piping cleaning system, with the cleaning refrigerant excessive, excess liquid refrigerant can be returned to the refrigerant cylinder via the refrigerant bleed line. With the internal pressure of the refrigerant cylinder too high, where the return of refrigerant to the refrigerant cylinder is stagnated, the pressure-reducing valve is opened so that the refrigerant gas is introduced into the transfer heat exchanger from the refrigerant cylinder via the depressurizing line, by which the pressure of the refrigerant cylinder can be held at an appropriate value. Thus, when cleaning refrigerant is excessive, the cleaning refrigerant can be speedily returned to the refrigerant cylinder from the cleaning circuit without stagnation.

Also, one aspect of the present invention provides a piping cleaning method for refrigeration units, in which refrigerant piping is cleaned by circulating a cleaning refrigerant through the refrigerant piping, the method comprising:

circulating liquid refrigerant through the refrigerant piping by two transfer heat exchangers provided on a heat pump use refrigerant circuit other than a cleaning circuit through which the cleaning refrigerant flows, the transfer heat exchangers alternately iterating a sucking operation by cooling a gas refrigerant within the transfer heat exchangers to effectuate depressurization thereof so that a refrigerant is sucked in from outside thereto, and a discharge operation by heating the refrigerant within the transfer heat exchangers to effectuate pressurization thereof so that a liquid refrigerant is discharged therefrom; and detecting an amount of cleaning refrigerant circulated through the refrigerant piping and, based on the detected amount of cleaning refrigerant, adjusting the amount of cleaning refrigerant.

In this method, the amount of cleaning refrigerant circulated through the refrigerant piping is detected and, based on this detected amount of cleaning refrigerant, the amount of cleaning refrigerant is adjusted. Therefore, the amount of cleaning refrigerant in the cleaning circuit can be set to an appropriate level without any excess or shortage, so that the refrigerant piping can be cleaned efficiently.

Also, a piping cleaning method for refrigeration units of one embodiment further comprises at least one of a step for resupplying a refrigerant to the cleaning circuit from a refrigerant resupply line which is connected to the heat exchangers and a step for bleeding the refrigerant of the cleaning circuit through a refrigerant bleed line which is connected to the transfer heat exchangers.

In this piping cleaning method, upon a shortage of cleaning refrigerant, the refrigerant resupply line is connected to the transfer heat exchangers and refrigerant is resupplied to the cleaning circuit through this refrigerant resupply line, by which the shortage of cleaning refrigerant can be refilled. Also, with the cleaning refrigerant excessive, the refrigerant bleed line is connected to the transfer exchangers, by which the refrigerant in the cleaning circuit is bled out through the refrigerant bleed line, the amount of cleaning refrigerant can be maintained at an appropriate level.

Also, in one embodiment, the heat pump use refrigerant circuit, which has a throttle mechanism connected between the two transfer heat exchangers, a compressor and a four-way switching valve, switches over a flowing direction of working refrigerant flowing through the two transfer heat exchangers by switching over the four-way switching valve, by which the sucking operation and the discharge operation of the two transfer heat exchangers are switched over, switches over the four-way switching valve when discharge pressure of the compressor becomes not less than a specified value, or when discharge temperature of the compressor becomes not more than a specified value, and detects a switching timing of the four-way switching valve, and based on this switching timing, detects the amount of cleaning refrigerant.

In this piping cleaning method, by switching over the flowing direction of refrigerant in the heat pump use refrigerant circuit by the four-way switching valve, the heat pump action is executed while cooling operation and pressurizing operation of the two heat exchangers are switched over, where the amount of cleaning refrigerant can be detected depending on the switching timing of the four-way switching valve.

Also, a piping cleaning system of one embodiment comprises a cleaning circuit for cleaning refrigerant piping by circulating a cleaning medium therethrough;

cleaning medium amount detecting means for detecting an amount of cleaning medium with which the refrigerant piping is cleaned; and adjusting means for adjusting cleaning medium amount based on the amount of cleaning medium detected by the detecting means.

According to this piping cleaning system, the refrigerant piping is cleaned by circulating the cleaning medium through the refrigerant circuit. In this process, the amount of cleaning medium with which the refrigerant piping is cleaned is detected by the cleaning medium detecting means and, based on this detected amount of cleaning medium, the amount of cleaning medium is adjusted by the adjusting means. Therefore, according to this piping cleaning system, any excess or shortage of the amount of cleaning medium with which the refrigerant piping is cleaned can be eliminated, and the refrigerant piping can be cleaned efficiently. An insufficient amount of cleaning medium would cause the cleaning performance to lower, and an excessive amount of cleaning medium would lead to less smooth circulation of the cleaning medium.

Also, in one embodiment, the cleaning medium is a mixed medium of detergent and refrigerant.

According to this piping cleaning system, since the refrigerant piping is cleaned by both detergent and refrigerant, the cleaning effect can be enhanced.

Also, one aspect of the present invention provides a piping cleaning system in which a liquid refrigerant is circulated through refrigerant piping by two transfer heat exchangers provided on a heat pump use refrigerant circuit other than a cleaning circuit through which a cleaning refrigerant flows, the transfer heat exchangers alternately iterating a sucking operation by cooling a gas refrigerant within the transfer heat exchangers to effectuate depressurization thereof so that a refrigerant is sucked in from outside thereto, and a discharge operation for heating the refrigerant within the transfer heat exchangers to effectuate pressurization thereof so that a liquid refrigerant is discharged therefrom, wherein the heat pump use refrigerant circuit has a throttle mechanism connected between the two transfer heat exchangers, a compressor and a four-way switching valve, and the piping cleaning system further comprises four-way switching valve switching means for switching over the four-way switching valve every specified time interval, thereby switching over a flowing direction of working refrigerant flowing through the two transfer heat exchangers, by which the sucking operation and the discharge operation of the two transfer heat exchangers are switched over.

According to this piping cleaning system, the four-way switching valve switching means switches over the four-way switching valve in the heat pump use refrigerant circuit every specified time interval. In this case, when the specified time interval is set to a time duration elapsing while the refrigerant within the transfer heat exchangers is cooled from an entirely gas-refrigerant state into an entirely liquid-refrigerant state, there can be offered a merit that the necessary number of times of switching of the four-way switching valve can be reduced. Also, since the four-way switching valve is switched over in specified time interval, the need of sensors for detecting the refrigerant amount is eliminated. In addition, even if the specified time interval is set to a time duration elapsing while the refrigerant within the transfer heat exchangers is heated from an entirely liquid-refrigerant state into an entirely gas-refrigerant state, similar effects can be obtained.

Also, one aspect of the present invention provides a piping cleaning method for refrigeration units, in which refrigerant piping is cleaned by circulating a cleaning medium through the refrigerant piping, the method comprising:

detecting an amount of cleaning medium with which the refrigerant piping is cleaned and, based on the detected amount of cleaning medium, adjusting the amount of cleaning medium.

According to this piping cleaning method, when the refrigerant piping is cleaned by circulating the cleaning medium through the cleaning circuit, the amount of cleaning medium with which the refrigerant piping is cleaned is detected and, based on this detected amount of cleaning medium, the amount of cleaning medium is adjusted. Therefore, any excess or shortage of the amount of cleaning medium with which the refrigerant piping is cleaned can be eliminated, so that the refrigerant piping can be cleaned efficiently.

Also, in one embodiment, the cleaning medium is a mixed medium of detergent and refrigerant.

According to this piping cleaning method, since the refrigerant piping is cleaned with both detergent and refrigerant, the cleaning effect can be enhanced.

Also, one aspect of the present invention provides a piping cleaning method including: circulating liquid refrigerant through refrigerant piping by two transfer heat exchangers provided on a heat pump use refrigerant circuit other than a cleaning circuit through which cleaning refrigerant flows, the transfer heat exchangers alternately iterating a sucking operation by cooling a gas refrigerant within the transfer heat exchangers to effectuate depressurization thereof so that a refrigerant is sucked in from outside thereto, and a discharge operation by heating the refrigerant within the transfer heat exchangers to effectuate pressurization thereof so that the liquid refrigerant is discharged therefrom; and detecting an amount of cleaning refrigerant circulated through the refrigerant piping and, based on the detected amount of cleaning refrigerant, adjusting the amount of cleaning refrigerant, wherein the heat pump use refrigerant circuit has a throttle mechanism connected between the two transfer heat exchangers, a compressor and a four-way switching valve, and switches over the four-way switching valve every specified time interval, thereby switching over a flowing direction of working refrigerant flowing through the two transfer heat exchangers, by which the sucking operation and the discharge operation of the two transfer heat exchangers are switched over.

According to this piping cleaning method, the four-way switching valve of the heat pump use refrigerant circuit is switched over every specified time interval. In this case, when the specified time interval is set to a time duration elapsing while the refrigerant within the transfer heat exchangers is cooled from an entirely gas-refrigerant state into an entirely liquid-refrigerant state, there can be offered a merit that the necessary number of times of switching of the four-way switching valve can be reduced. Also, since the four-way switching valve is switched over in specified time interval, the need of sensors for detecting the refrigerant amount is eliminated. In addition, the specified time interval may also be set to a time duration elapsing while the refrigerant within the transfer heat exchangers is heated from an entirely liquid-refrigerant state into an entirely gas-refrigerant state.

BEST MODE FOR CARRYING OUT THE INVENTION

Figure 1:
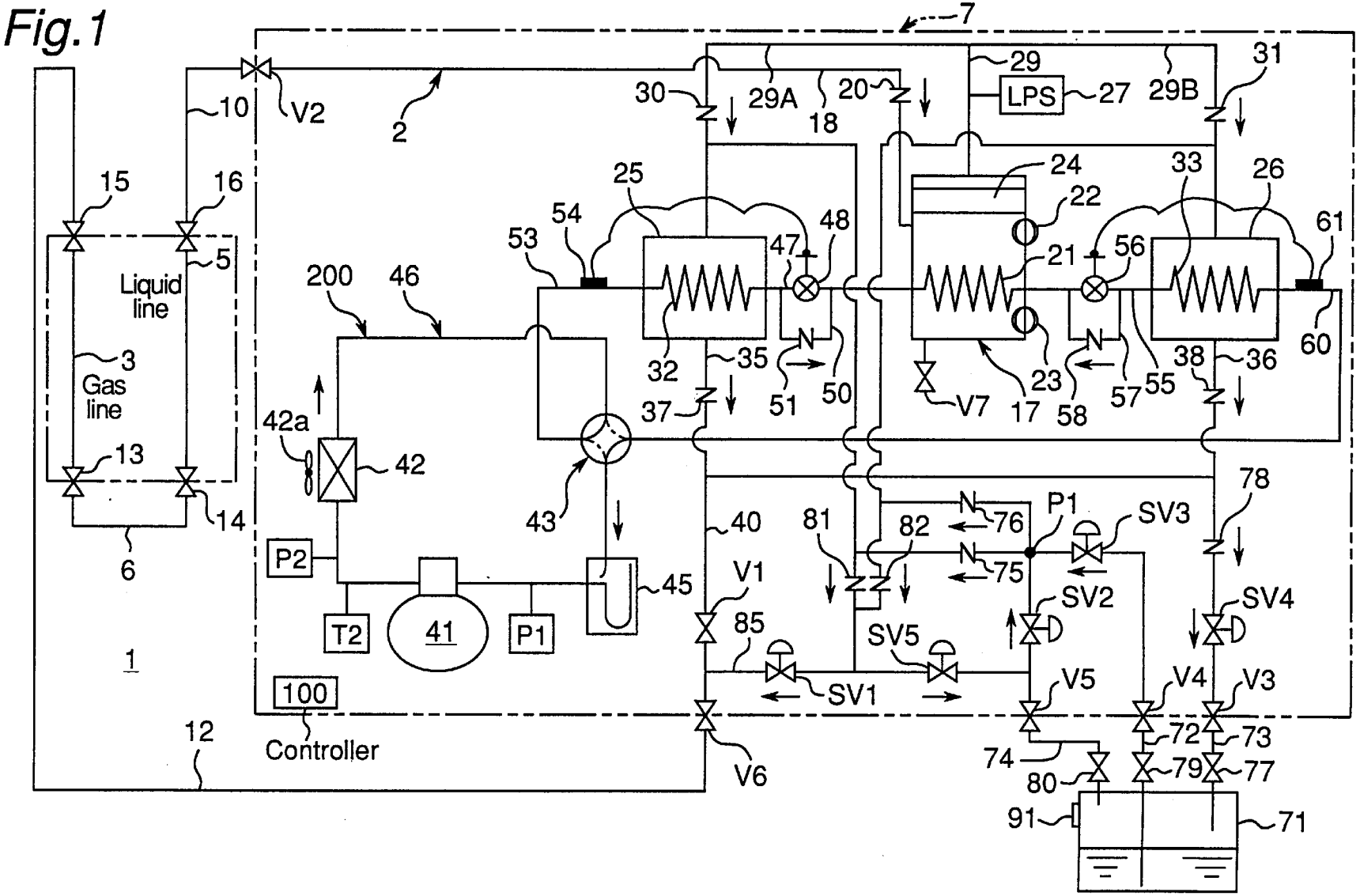
FIG. 1 is a refrigerant circuit diagram showing an embodiment of a piping cleaning system for refrigeration units according to the present invention.

Hereinbelow, the present invention is described in detail by way of embodiments thereof illustrated in the accompanying drawing.

FIG. 1 shows an embodiment of the piping cleaning system for refrigeration units according to the present invention. The piping cleaning system 1 is equipped with a cleaning circuit 2. In this cleaning circuit 2, a cleaning refrigerant, which is given by R22, is circulated to clean existing connecting piping which comprises a gas line 3 and a liquid line 5. This cleaning circuit 2 has a pipe 6 for directly connecting a valve 13 provided at an end of the gas line 3 and a valve 14 provided at an end of the liquid line 5 to each other, a pipe 10 connected between a valve 16 provided at the other end of the liquid line 5 and a valve V2 provided at an inflow port of a cleaning unit 7, and a pipe 12 connected between a valve 15 provided at the other end of the gas line 3 and a valve V6 provided at an outflow port of the cleaning unit 7.

The cleaning unit 7 is provided with an oil separator 17, and a liquid refrigerant is introduced into the oil separator 17 through an introductory pipe 18 connected between the oil separator 17 and the valve V2 placed at the inflow port. Also, the introductory pipe 18 is provided with a check valve 20 which permits a refrigerant flow from the valve V2 to the oil separator 17. The introductory pipe 18 is connected at a point of a side wall of the oil separator 17 slightly upper than the vertical center of the side wall.

The oil separator 17 has, in lower part, a heat exchanging coil 21, and this heat exchanging coil 21 is connected to a later-described heat pump circuit. With this heat exchanging coil 21, the liquid refrigerant introduced from the introductory pipe 18 is evaporated. Also, an upper liquid level sensor 22 and a lower liquid level sensor 23 are attached on a side wall of the oil separator 17 at upper and lower positions of the coil 21. These upper liquid level sensor 22 and lower liquid level sensor 23 are implemented by float switches.

The oil separator 17 has a filter 24 fitted thereto at a position slightly below a top plate thereof and above the connecting point of the introductory pipe 18. When the refrigerant evaporated by the coil 21 passes through the filter 24, foreign matters in the refrigerant are removed by the passage. Further, a discharge valve V7 is set at the bottom of the oil separator 17, so that oil accumulated at the bottom can be discharged through this discharge valve V7.

A pipe 29 is connected to the top plate of the oil separator 17, and this pipe 29 is branched into pipes 29A and 29B so as to be connected to the top plate of a first transfer heat exchanger 25 and the top plate of a second transfer heat exchanger 26, respectively. The pipe 29 has a low pressure sensor 27 provided above the top plate of the oil separator 17. Also, the pipes 29A, 29B are equipped with check valves 30, 31, respectively. These check valves 30, 31 permit refrigerant flows from the oil separator 17 to the transfer heat exchangers 25, 26, respectively.

The transfer heat exchangers 25, 26 have heat exchanging coils 32, 33, and the heat exchanging coils 32, 33 are connected to a later-described heat pump circuit 200. Then, pipes 35, 36 are connected to bottoms of the transfer heat exchangers 25, 26, respectively, and these pipes 35, 36 are connected to a merged pipe 40 via check valves 37, 38 (forward directed toward the valve V6 placed at the outflow port), respectively. This merged pipe 40 is connected via a valve V1 to the valve V6 placed at the outflow port.

Meanwhile, the heat pump circuit 200 has piping 46 for connecting a compressor 41, a heat exchanger 42, a four-way switching valve 43, the first transfer heat exchanger 25, the oil separator 17, the second transfer heat exchanger 26, the four-way switching valve 43, an accumulator 45 and the compressor 41 in this order. A motor-operated expansion valve 48 is provided on a pipe 47 for connecting the first transfer heat exchanger 25 and the oil separator 17 to each other, and a check valve 51 (forward directed toward the oil separator 17) is provided on a pipe 50 which bypasses this motor-operated expansion valve 48. The motor-operated expansion valve 48 is controlled in degree of openness with a signal derived from a heat sensing cylinder 54 attached to a pipe 53 placed on a side opposite to the motor-operated expansion valve 48 with respect to the first transfer heat exchanger 25. Also, a motor-operated expansion valve 56 is provided on a pipe 55 which connects the oil separator 17 and the second transfer heat exchanger 26 to each other, and a check valve 58 (forward directed toward the oil separator 17) is provided on a pipe 57 which bypasses this motor-operated expansion valve 56. The motor-operated expansion valve 56 is controlled in degree of openness with a signal derived from a heat sensing cylinder 61 attached to a pipe 60 placed on a side opposite to the motor expansion valve 58 with respect to the second transfer heat exchanger 26.

Besides, a pressure sensor P1 is attached on a suction-side pipe of the compressor 41, while a temperature sensor T2 and a pressure sensor P2 are attached on a discharge-side pipe of the compressor 41.

Further, a refrigerant cylinder 71 is connected to the cleaning unit 7. This refrigerant cylinder 71 is connected to the cleaning unit 7 by means of a refrigerant resupply line 72, a refrigerant bleed line 73 and a pressurizing line 74. The refrigerant resupply line 72 is piping for resupplying the cleaning refrigerant to the first, second transfer heat exchangers 25, 26, and the refrigerant bleed line 73 is piping for returning the cleaning refrigerant from the first, second transfer heat exchangers 25, 26 to the refrigerant cylinder 71. Also, the pressurizing line 74 is piping for enhancing the internal pressure of the refrigerant cylinder 71 by introducing a gas refrigerant to the refrigerant cylinder 71 from the first, second transfer heat exchangers 25, 26.

The refrigerant resupply line 72 is connected to a solenoid valve SV3 via a valve 79 and a valve V4, and branched into two beyond the solenoid valve SV3 and further, via check valves 75, 76 (forward directed toward the transfer heat exchangers 25, 26), connected to the branch pipes 29A, 29B in the downstream of the check valves 30, 31.

The refrigerant bleed line 73 is connected to a solenoid valve SV4 via a valve 77 and a valve V3, and via this solenoid valve SV4 to a check valve 78 (forward directed toward the refrigerant cylinder 71), connected to a pipe 36 in the downstream of the check valve 38.

The pressurizing line 74 is connected to a solenoid valve SV5 via a valve 80 and a valve V5, and branched into two beyond the solenoid valve SV5 and further, via check valves 81, 82 (forward directed toward the refrigerant cylinder 71), connected to the refrigerant resupply line 72 in the downstream of the check valves 75, 76.

Also, the pressurizing line 74 between the valve V5 and the solenoid valve SV5 is connected to a branch point P1 of the refrigerant resupply line 72 via a solenoid valve SV2. When the solenoid valve SV2 is opened with the refrigerant cylinder 71 under a high pressure, the cylinder 71 can be degassed to the resupply line 72. In doing this, the pressurizing line 74 plays a role of depressurizing line.

Also, the pressurizing line 74 is connected to the merged pipe 40 with a pipe 85 having the solenoid valve SV1 from between the solenoid valve SV5 and the check valves 81, 82 to between the valve V1 and the valve V6 provided at the outflow port.

(Basic Cleaning Operation)

Next, basic operation of the piping cleaning system of this construction is explained. First, while the four-way switching valve 43 of the heat pump circuit 200 is in a state shown by solid line in FIG. 1, the compressor 41 is operated, by which a liquid refrigerant is transferred from the heat exchanger 42 to the first transfer heat exchanger 25 by the compressor 41. Then, the first transfer heat exchanger 25 serves as a condenser. In addition, the heat exchanger 42 plays a role of controlling the refrigerant temperature by making the heat of the refrigerant discharged out to a specified amount at a preceding stage of the first transfer heat exchanger 25. This heat exchange amount of the heat exchanger 42 can be controlled by turning on/off a fan 42*a*. Also, the degree of openness of the motor-operated expansion valve 48 is changed depending on the level of the temperature detected by the heat sensing cylinder 54 attached on the pipe 53, so that the temperature of the refrigerant that flows into the oil separator 17 is held within a specified temperature range. With a small degree of openness of the motor-operated expansion valve 48, the amount of refrigerant that flows from the bypass pipe 50 via the check valve 51 into the oil separator 17 increases.

Then, the refrigerant that has lowered in temperature through the first transfer heat exchanger 25 flows into the heat exchanging coil 21 of the oil separator 17, where the refrigerant heats and evaporates the cleaning refrigerant that has flowed into the oil separator 17 by passing through the introductory pipe 18 via the valve V2.

The refrigerant that has been further cooled by having passed through the oil separator 17 subsequently passes through the motor-operated expansion valve 56 or the bypass pipe 57, flowing into the heat exchanging coil 33 of the second transfer heat exchanger 26. Then, this second transfer heat exchanger 26 serves as an evaporator. In addition, the degree of openness of the motor-operated expansion valve 56 is changed, larger or smaller, depending on the level of the temperature detected by the heat sensing cylinder 61 attached on the pipe 60, so that the temperature of the refrigerant that flows into the second transfer heat exchanger 26 is held within a specified temperature range. In the case where the four-way switching valve 43 has been switched over to the broken-line position, with a small degree of openness of the motor-operated expansion valve 56, the amount of refrigerant that flows from the bypass pipe 57 into the second transfer heat exchanger 26 increases.

Then, the refrigerant that has passed through the second transfer heat exchanger 26 enters the accumulator 45 via the four-way switching valve 43 and thereafter, in a gaseous state, returns to the compressor 41.

By such operation of the heat pump circuit 200, the cleaning refrigerant that has flowed in from the valve V2 placed at the inflow port of the cleaning unit 7 first flows into the oil separator 17, where the cleaning refrigerant is evaporated by the lower-part heat exchanging coil 21, thereby separated from oil, and foreign matters are removed by the upper-part filter 24. Then, the cleaning refrigerant, while transformed into a gaseous state, goes up through the pipe 29.

At the time, the second transfer heat exchanger 26 is in sucking operation, while the first transfer heat exchanger 25 is in discharging operation. Therefore, the cleaning refrigerant flows from the pipe 29 toward the pipe 29B, and cooled by the heat exchanging coil 33 of the second transfer heat exchanger 26, thereby being transformed from a gas refrigerant into a liquid refrigerant and accumulated within the second transfer heat exchanger 26. Then, when the second transfer heat exchanger 26 is filled with the liquid-phase cleaning refrigerant, the pump-side refrigerant, as it is cooled, is sucked into the compressor 41, causing the discharge temperature of the compressor 41 to lower, with the result that the detected temperature of the temperature sensor T2 lowers below a specified temperature. Then, a controller 100, receiving a signal from the temperature sensor T2, switches the four-way switching valve 43 to the broken-line position.

Then, the refrigerant flowing direction of the heat pump circuit 200 is switched over, so that the first transfer heat exchanger 25 performs a cooling operation while the second transfer heat exchanger 26 performs a heating operation. As a result of this, the cleaning refrigerant in the gaseous state derived from the oil separator 17 flows into the first transfer heat exchanger 25, and cooled so as to be transformed into a liquid refrigerant and accumulated within the first transfer heat exchanger 25. Meanwhile, in the second transfer heat exchanger 26, the liquid refrigerant accumulated by the preceding cooling operation is heated and increased in pressure, and sent out to the pipe 36.

Then, subsequently, when the liquid refrigerant is accumulated and filled up in the first transfer heat exchanger 25, the cooled refrigerant flows from the pipe 53 into the compressor 41 so that the controller 100 switches over the four-way switching valve 43 to the solid-line position upon receiving a signal derived from the temperature sensor T2.

In addition, in the above description, it has been arranged that the four-way switching valve 43 is switched over when the discharge temperature of the compressor 41 has lowered by the refrigerant flowing from a transfer heat exchanger that performs the cooling operation into the compressor 41. Otherwise, the four-way switching valve 43 may also be switched over by detecting with the pressure sensor P2 that the discharge pressure of the compressor 41 has increased by the liquid-phase cleaning refrigerant having all flowed out from the transfer heat exchanger that performs the heating operation so that the heat exchange amount of the refrigerant on the pump circuit side has lowered. Furthermore, the four-way switching valve 43 may be switched over when the internal pressure of the oil separator 17 detected by the low pressure sensor 27 has increased to the discharge temperature equivalent saturation pressure of the compressor 41 by the liquid-phase cleaning refrigerant being filled in the transfer heat exchanger that performs the cooling operation.

By the basic operation of the heat pump as described above, the gas line 3 and the liquid line 5 as existing connecting piping can be cleaned with the cleaning refrigerant forcedly circulated through the cleaning circuit 2. Accordingly, it becomes feasible to reuse the existing connecting piping, so that the laying work can be simplified to a great extent.

It is noted that all the solenoid valves SV1, SV2, SV3, SV4 and SV5 are kept closed in the above basic operation.

(Cleaning Refrigerant Resupply Operation)

Next, an operation of resupplying the cleaning refrigerant from the refrigerant cylinder 71 to the cleaning circuit 2 upon a shortage of the cleaning refrigerant during the cleaning operation in the above-described basic operation is explained.

A lowered amount of cleaning refrigerant in the cleaning circuit 2 would lead to a lower heat exchange amount with working refrigerant in the heat pump circuit 200, and a faster increasing rate of discharge pressure as well as a faster decreasing rate of discharge temperature in the compressor, resulting in a shorter switching cycle period of the four-way switching valve 43. The resultant shorter switching period (e.g. less than 2 min.) of the four-way switching valve 43 is detected by the controller 100, and the solenoid valve SV3 of the refrigerant resupply line 72 is kept opened for a specified time (e.g. 15 sec.). As a result, it becomes possible to feed the supply cleaning refrigerant from the refrigerant cylinder 71 via the refrigerant resupply line 72 to the low-pressure one out of the first, second transfer heat exchangers 25, 26 that performs the cooling operation.

Next, the switching period of the four-way switching valve 43 is monitored for a monitoring period of about 10 minutes by the controller 100. As a result of this monitoring, if the switching period of the four-way switching valve 43 is not changed longer but kept short as it is, it is decided that the pressure of the refrigerant cylinder 71 is so low that the cleaning refrigerant cannot be resupplied to the transfer heat exchanger 25 or 26, where the pressurizing operation for the refrigerant cylinder 71 is executed. On the other hand, if the switching period of the four-way switching valve 43 is changed longer but still shorter than a prescribed switching period, the solenoid valve SV3 is opened again for a specified time. Also, as a result of the monitoring, if the switching period returns to the prescribed switching period, the controller 100 decides that the cleaning refrigerant has been resupplied from the refrigerant cylinder 71 via the resupply line 72 to the refrigerant circuit 2, thus continuing the above-described basic operation. In this way, shortage of the cleaning refrigerant is refilled so that the piping (gas line 3, liquid line 5) can be cleaned efficiently without lowering the cleaning performance.

In addition, as a result of the monitoring, if the switching period has become longer than the prescribed switching period, it is decided that the cleaning refrigerant has been overcharged, and the next-described refrigerant bleeding operation during the piping cleaning is executed.

(Cleaning Refrigerant Bleeding Operation)

Next, an operation of returning excess cleaning refrigerant from the cleaning circuit 2 to the refrigerant cylinder 71 upon an overcharge of the cleaning refrigerant to the cleaning circuit 2 is explained.

An excessive amount of cleaning refrigerant in the cleaning circuit 2 would lead to an increased amount of heat exchange with working refrigerant in the heat pump circuit 200, and a slower increasing rate of discharge pressure as well as a slower decreasing rate of discharge temperature in the compressor, resulting in a longer switching cycle period of the four-way switching valve 43. The resultant longer switching period (e.g. more than 2 min.) of the four-way switching valve 43 is detected by the controller 100, and the solenoid valve SV4 of the refrigerant bleed line 73 is kept opened for a specified time (e.g. 15 sec.). As a result, it becomes possible to return the excess cleaning refrigerant from the higher-pressure one out of the first, second transfer heat exchangers 25, 26 that performs the heating operation, via the pipe 35 or 36 through the refrigerant bleed line 73 toward the refrigerant cylinder 71.

Next, the switching period of the four-way switching valve 43 is monitored for a monitoring period of about 10 minutes by the controller 100. As a result of this monitoring, if the switching period of the four-way switching valve 43 is not changed shorter but kept long as it is, it is decided that the pressure of the refrigerant cylinder 71 is so high that the excess refrigerant cannot be returned from the transfer heat exchanger 25 or 26 to the refrigerant cylinder 71, where a degassing operation for the refrigerant cylinder 71 which will be described in the following paragraph is executed. On the other hand, if the switching period of the four-way switching valve 43 is changed shorter but still longer than a predetermined prescribed switching period, it is decided that the cleaning refrigerant is still excessive in the cleaning circuit 2, and so the solenoid valve SV4 is opened again for a specified time. Also, as a result of the monitoring, if the switching period returns to the prescribed switching period, the controller 100 decides that the excess refrigerant has been completely returned via the refrigerant bleed line 73 to the refrigerant cylinder 71, thus continuing the above-described basic operation.

As shown above, in the case where the cleaning refrigerant is excessive, the excess refrigerant is bled via the refrigerant bleed line 73 to the refrigerant cylinder 71, so that the amount of cleaning refrigerant in the cleaning circuit 2 can be maintained normally at an appropriate level and that the piping (gas line 3, liquid line 5) can be cleaned efficiently.

In addition, as a result of the monitoring, if the switching period has become shorter than the prescribed switching period, it is decided that the cleaning refrigerant has run short, and the above-described cleaning refrigerant resupply operation is executed.

(Degassing Operation of Refrigerant Cylinder)

Next, an operation of degassing the gas refrigerant from the refrigerant cylinder 71 and returning the refrigerant to the cleaning circuit 2 upon an increase in the internal pressure of the refrigerant cylinder 71 due to the gas refrigerant within the cylinder 71 is explained.

With a high internal pressure of the refrigerant cylinder 71, or with the refrigerant cylinder 71 filled up, in an attempt to return excess refrigerant from the cleaning circuit 2 to the refrigerant cylinder 71 by the aforementioned cleaning bleeding operation, the refrigerant would not be returned from the refrigerant bleed line 73 to the refrigerant cylinder 71. When a float switch 91 attached to the refrigerant cylinder 71 indicates that the refrigerant cylinder 71 has been filled up, the refrigerant cylinder 71 should be replaced. When the refrigerant bleeding operation is disabled with the float switch 91 not indicating a full, the controller 100, deciding that the internal pressure of the refrigerant cylinder 71 has been increased, performs the degassing operation of the refrigerant cylinder 71. In this case, it is also possible to directly measure the internal pressure of the refrigerant cylinder 71 to verify that the internal pressure has been increased. Further, with the provision of a pressure sensor for detecting the internal pressure of the refrigerant cylinder 71, the degassing operation for the refrigerant cylinder 71 may be automatically carried out by detecting by means of the controller 100 that the internal pressure of the refrigerant cylinder 71 has increased.

As to the above degassing operation, the solenoid valve SV2 is kept opened for a specified time period (e.g., 15 sec.), so that upper part of the refrigerant cylinder 71 is communicated with upper parts of the transfer heat exchangers 25, 26 via the valve V5, the solenoid valve SV2 and the check valves 75, 76. As a result of this, the pressurizing line 74 serves as a depressurizing line so that the gas refrigerant within the refrigerant cylinder 71 can be bled via the solenoid valve SV2 serving as a pressure-reducing valve toward a cooling-side heat exchanger out of the transfer heat exchangers 25 and 26.

By such a degassing operation for the refrigerant cylinder 71, the cleaning refrigerant can be returned smoothly from the cleaning circuit 2 to the refrigerant cylinder 71.

(Pressurizing Operation onto Refrigerant Cylinder)

Next, an operation of increasing the internal pressure of the refrigerant cylinder 71 upon a lowering of the internal pressure within the refrigerant cylinder 71 is explained.

When the internal pressure of the refrigerant cylinder 71 is lower or when the refrigerant cylinder 71 is empty, even in an attempt to supply the cleaning refrigerant from the refrigerant cylinder 71 to the cleaning circuit 2 by the foregoing cleaning refrigerant resupply operation, the cleaning refrigerant could not be supplied from the refrigerant resupply line 72 to the cleaning circuit 2. In this case, if the float switch 91 of the refrigerant cylinder 71 indicates that the refrigerant cylinder 71 is empty, the refrigerant cylinder 71 should be replaced.

On the other hand, if the float switch 91 indicates that the refrigerant cylinder 71 is not empty, it is decided that the internal pressure of the refrigerant cylinder 71 has been lowered, where the pressurizing operation for the refrigerant cylinder 71 is carried out. In this case, it is also possible to directly measure the internal pressure of the refrigerant cylinder 71 to verify that the internal pressure has been lowered. Further, with the provision of a pressure sensor for detecting the internal pressure of the refrigerant cylinder 71, the pressurizing operation onto the refrigerant cylinder 71 may be automatically carried out by detecting by means of the controller 100 that the internal pressure of the refrigerant cylinder 71 has lowered.

For the pressurizing operation, the solenoid valve SV5 is kept opened for a specified time (e.g., 15 sec.) so that upper part of the refrigerant cylinder 71 is communicated with upper parts of the transfer heat exchangers 25, 26 via the valve V5, the solenoid valve SV5 and the check valves 81, 82. As a result of this, hot gas refrigerant can be introduced from the heating-side heat exchanger out of the transfer heat exchangers 25 and 26 toward the refrigerant cylinder 71.

By such a pressurizing operation from the cleaning circuit 2 onto the refrigerant cylinder 71, a specified level of internal pressure of the refrigerant cylinder 71 can be held, and the cleaning refrigerant can be supplied from the refrigerant cylinder 71 to the cleaning circuit 2 smoothly.

In addition, in this embodiment, the excess or shortage of the cleaning refrigerant is decided depending on the longness or shortness of the switching period of the four-way switching valve 43. Otherwise, it is also possible to decide the excess or shortage of the cleaning refrigerant by the liquid level sensors 22, 23 provided on the oil separator 17. That is, it may be arranged that if the liquid level in the oil separator 17 is over the upper liquid level sensor 22, the amount of cleaning refrigerant is decided to be excessive, and that if the liquid level is below the lower liquid level sensor 23, the amount of cleaning refrigerant is decided to be short.

Although the cleaning refrigerant of the cleaning circuit 2 is circulated by the heat pump circuit 200 in the above embodiment, the cleaning refrigerant may also be circulated by an ordinary transfer pump.

Further, although the refrigerant piping is cleaned with a refrigerant, yet a cleaning medium may be used. This cleaning medium refers to, for example, a detergent only, or a mixed medium of detergent and refrigerant. This mixed refrigerant of detergent and refrigerant is not only capable of enhancing the cleaning effect in cleaning the refrigerant piping but also easy to treat, hence particularly effective.

Also, it is also possible that the controller 100 switches the four-way switching valve 43 every specified time interval, where this specified time interval may be set to a time duration elapsing while the refrigerant within the transfer heat exchangers 25, 26 is cooled from an entirely gas-refrigerant state into an entirely liquid-refrigerant state. In this case, the number of times of switching of the four-way switching valve 43 can be reduced. Further, because the four-way switching valve 43 is switched according to the time setting, the need of a sensor for detecting the amount of cleaning refrigerant is eliminated. In addition, the above-noted specified time may be set to a time duration elapsing while the refrigerant within the transfer heat exchangers 25, 26 is heated from an entirely liquid-refrigerant state into an entirely gas-refrigerant state.

INDUSTRIAL APPLICABILITY

As described above, the piping cleaning system and the piping cleaning method for refrigeration units according to the present invention are applicable for cleaning and reusing existing refrigerant piping, and in particular useful to cases where HCF refrigerants are used instead of CFC or HCFC refrigerants.

What is claimed is:

1. A piping cleaning system for refrigeration units, comprising:

a cleaning circuit (2) for cleaning refrigerant piping (3, 5) by circulating a refrigerant therethrough;

refrigerant amount detecting means (100, 22, 23) for detecting an amount of refrigerant with which the refrigerant piping (3, 5) is cleaned; and adjusting means (72, 73) for adjusting cleaning refrigerant amount based on the amount of refrigerant detected by the refrigerant amount detecting means (100, 22, 23).

2. The piping cleaning system for refrigeration units according to claim 1, further comprising:

a transfer heat exchanger (25, 26) provided halfway on the cleaning circuit (2); and a heat pump to cause the transfer heat exchanger (25, 26) to alternately iterate a sucking operation by cooling a gas refrigerant within the transfer heat exchanger (25, 26) to effectuate depressurization thereof so that a refrigerant is sucked in from outside thereto, and a discharge operation by heating the refrigerant within the transfer heat exchanger (25, 26) to effectuate pressurization thereof so that a liquid refrigerant is discharged therefrom, for circulating a liquid refrigerant through the refrigerant piping (3, 5) by the transfer heat exchanger (25, 26).

3. The piping cleaning system for refrigeration units according to claim 1, further comprising two transfer heat exchangers (25, 26) provided halfway on the cleaning circuit (2) and connected in parallel to each other; and a heat pump to cause the transfer exchangers (25, 26) to alternately iterate a sucking operation by cooling a gas refrigerant within the transfer heat exchangers (25, 26) to effectuate depressurization thereof so that a refrigerant is sucked in from outside thereto, and a discharge operation by heating the refrigerant within the transfer heat exchangers (25, 26) to effectuate pressurization thereof so that a liquid refrigerant is discharged therefrom, for circulating a liquid refrigerant through the refrigerant piping (3, 5) by the transfer heat exchangers (25, 26).

4. The piping cleaning system for refrigeration units according to claim 2 wherein the adjusting means of the cleaning refrigerant amount is implemented by at least one of a refrigerant resupply line (72) connected to the transfer heat exchanger (25, 26) and serving for resupplying the refrigerant to the cleaning circuit (2) and a refrigerant bleed line (73) connected to the transfer heat exchanger (25, 26) and serving for taking out the refrigerant from the cleaning circuit (2).

5. The piping cleaning system for refrigeration units according to claim 1, wherein separating means (17) for separating foreign matters from the refrigerant is connected to the cleaning circuit (2), and the refrigerant amount detecting means is implemented by a refrigerant level sensor (22, 23) provided on the separating means (17).

6. The piping cleaning system for refrigeration units according to claim 3, wherein the heat pump has a throttle mechanism (48, 56) connected between the two transfer heat exchangers (25, 26), a compressor (41) and a four-way switching valve (43), and also has a heat pump circuit other than the cleaning circuit (2) through which the cleaning refrigerant flows, wherein a flowing direction of working refrigerant flowing through the heat pump circuit is switched over by switching over the four-way switching valve (43), by which the sucking operation and the discharge operation of the two transfer heat exchangers (25, 26) are switched over;

the piping cleaning system further comprises four-way switching valve switching means (100) for switching over the four-way switching valve (43) when discharge pressure of the compressor (41) becomes not less than a specified value, or when discharge gas temperature of the compressor (41) becomes not more than a specified value, or when suction gas pressure of the compressor (41) becomes not more than a specified value; and wherein the refrigerant amount detecting means (100)

detects a switching timing of the four-way switching valve switching means (100), and based on this switching timing, detects the amount of cleaning refrigerant.

7. The piping cleaning system for refrigeration units according to claim 4, further comprising:

the refrigerant resupply line (72) connected to a refrigerant cylinder (71);

a pressurizing line (74) for introducing to the refrigerant cylinder (71) a refrigerant gas pressurized by the transfer heat exchanger (25, 26) in order to pressurize the refrigerant cylinder (71); and a pressurizing valve (SV5) provided on the pressurizing line (74).

8. The piping cleaning system for refrigeration units according to claim 4, further comprising:

the refrigerant bleed line (73) connected to a refrigerant cylinder (71);

a depressurizing line (74) for introducing a refrigerant gas from the refrigerant cylinder (71) to the transfer heat exchanger (25, 26) in order to depressurize the inter of the refrigerant cylinder (71) by cooling the refrigerant gas within the refrigerant cylinder (71) with the transfer heat exchanger (25, 26); and a pressure-reducing valve (SV2) provided on the depressurizing line (74).

9. A piping cleaning method for refrigeration units, in which refrigerant piping (3, 5) is cleaned by circulating a cleaning refrigerant through the refrigerant piping, the method comprising:

circulating liquid refrigerant through the refrigerant piping (3, 5) by two transfer heat exchangers (25, 26) provided on a heat pump use refrigerant circuit other than a cleaning circuit (2) through which the cleaning refrigerant flows, the transfer heat exchangers (25, 26) alternately iterating a sucking operation by cooling a gas refrigerant within the transfer heat exchangers (25, 26) to effectuate depressurization thereof so that a refrigerant is sucked in from outside thereto, and a discharge operation by heating the refrigerant within the transfer heat exchangers (25, 26) to effectuate pressurization thereof so that a liquid refrigerant is discharged therefrom; and detecting an amount of cleaning refrigerant circulated through the refrigerant piping (3, 5) and, based on the detected amount of cleaning refrigerant, adjusting the amount of cleaning refrigerant.

10. The piping cleaning method for refrigeration units according to claim 9, further comprising:

at least one of a step for resupplying a refrigerant to the cleaning circuit (2) from a refrigerant resupply line (72) which is connected to the heat exchangers (25, 26) and a step for bleeding the refrigerant of the cleaning circuit (2) through a refrigerant bleed line (73) which is connected to the transfer heat exchangers (25, 26).

11. The piping cleaning method for refrigeration units according to claim 9, wherein the heat pump use refrigerant circuit, which has a throttle mechanism (48, 56) connected between the two transfer heat exchangers (25, 26), a compressor (41) and a four-way switching valve (43), switches over a flowing direction of working refrigerant flowing through the two transfer heat exchangers (25, 26) by switching over the four-way switching valve (43), by which the sucking operation and the discharge operation of the two transfer heat exchangers (25, 26) are switched over, switches over the four-way switching valve (43) when discharge pressure of the compressor (41) becomes not less than a specified value, or when discharge temperature of the compressor becomes not more than a specified value, and detects a switching timing of the four-way switching valve (43), and based on this switching timing, detects the amount of cleaning refrigerant.

12. A piping cleaning system for refrigeration units comprising:

a cleaning circuit (2) for cleaning refrigerant piping (3, 5) by circulating a cleaning medium therethrough;

cleaning medium amount detecting means (100, 22, 23) for detecting an amount of cleaning medium with which the refrigerant piping (3, 5) is cleaned; and adjusting means (72, 73) for adjusting cleaning medium amount based on the amount of cleaning medium detected by the detecting means (100, 22, 23).

13. The piping cleaning system according to claim 12, wherein the cleaning medium is a mixed medium of detergent and refrigerant.

14. A piping cleaning system in which a liquid refrigerant is circulated through refrigerant piping (3, 5) by two transfer heat exchangers (25, 26) provided on a heat pump use refrigerant circuit other than a cleaning circuit (2) through which a cleaning refrigerant flows, the transfer heat exchangers (25, 26) alternately iterating a sucking operation by cooling a gas refrigerant within the transfer heat exchangers (25, 26) to effectuate depressurization thereof so that a refrigerant is sucked in from outside thereto, and a discharge operation for heating the refrigerant within the transfer heat exchangers (25, 26) to effectuate pressurization thereof so that a liquid refrigerant is discharged therefrom, wherein the heat pump use refrigerant circuit has a throttle mechanism (48, 56) connected between the two transfer heat exchangers (25, 26), a compressor (41) and a four-way switching valve (43), and the piping cleaning system further comprises four-way switching valve switching means (100) for switching over the four-way switching valve (43) every specified time interval, thereby switching over a flowing direction of working refrigerant flowing through the two transfer heat exchangers (25, 26), by which the sucking operation and the discharge operation of the two transfer heat exchangers (25, 26) are switched over.

15. A piping cleaning method for refrigeration units, in which refrigerant piping (3, 5) is cleaned by circulating a cleaning medium through the refrigerant piping, the method comprising:

detecting an amount of cleaning medium with which the refrigerant piping (3, 5) is cleaned and, based on the detected amount of cleaning medium, adjusting the amount of cleaning medium.

16. The piping cleaning method according to claim 15, wherein the cleaning medium is a mixed medium of detergent and refrigerant.

17. A piping cleaning method including: circulating liquid refrigerant through refrigerant piping (3, 5) by two transfer heat exchangers (25, 26) provided on a heat pump use refrigerant circuit other than a cleaning circuit (2) through which cleaning refrigerant flows, the transfer heat exchangers (25, 26) alternately iterating a sucking operation by cooling a gas refrigerant within the transfer heat exchangers (25, 26) to effectuate depressurization thereof so that a refrigerant is sucked in from outside thereto, and a discharge operation by heating the refrigerant within the transfer heat exchangers (25, 26) to effectuate pressurization thereof so that the liquid refrigerant is discharged therefrom; and detecting an amount of cleaning refrigerant circulated through the refrigerant piping (3, 5) and, based on the detected amount of cleaning refrigerant, adjusting the amount of cleaning refrigerant, wherein the heat pump use refrigerant circuit has a throttle mechanism (48, 56) connected between the two transfer heat exchangers (25, 26), a compressor (41) and a four-way switching valve (43), and switches over the four-way switching valve (43) every specified time interval, thereby switching over a flowing direction of working refrigerant flowing through the two transfer heat exchangers (25, 26), by which the sucking operation and the discharge operation of the two transfer heat exchangers (25, 26) are switched over.

* * * * *